United States Patent [19]

Hornagold

[11] 4,071,147

[45] Jan. 31, 1978

[54] MOUNTING FOR AN OUTRIGGER CYLINDER ON A CRANE

[75] Inventor: John T. Hornagold, Waukesha, Wis.

[73] Assignee: Bucyrus-Erie Company, South Milwaukee, Wis.

[21] Appl. No.: 596,827

[22] Filed: July 17, 1975

Related U.S. Application Data

[63] Continuation of Ser. No. 412,374, Nov. 1, 1973, abandoned.

[51] Int. Cl.[2] ..... B66C 23/62

[52] U.S. Cl. ..... 212/145; 248/354 R; 280/766

[58] Field of Search ..... 212/145, 144; 280/763–766; 248/354 R; 104/263; 214/141

[56] References Cited

U.S. PATENT DOCUMENTS

| | | | |
|---|---|---|---|
| 2,555,336 | 6/1951 | Hagely | 212/145 X |
| 2,885,181 | 5/1959 | McCully et al. | 212/145 X |
| 3,020,858 | 2/1962 | Perkin et al. | 105/215 C |
| 3,315,942 | 4/1967 | Buberniak | 212/145 X |
| 3,396,854 | 8/1968 | Crisp | 212/145 |
| 3,677,417 | 7/1972 | Keller et al. | 212/145 |
| 3,754,777 | 8/1973 | Riggs et al. | 212/145 X |

FOREIGN PATENT DOCUMENTS

| | | | |
|---|---|---|---|
| 1,251,928 | 10/1967 | Germany | 212/145 |

*Primary Examiner*—Robert J. Spar
*Assistant Examiner*—R. B. Johnson
*Attorney, Agent, or Firm*—Quarles & Brady

[57] ABSTRACT

An improved mounting arrangement for the vertical cylinder of an extensible outrigger assembly includes laterally extending plates on the cylinder that are connected to the beam side walls by two transverse mounting pins, one of which also functions as a connection point for the horizontal cylinder that actuates the outrigger beam. In the preferred embodiment, the vertical cylinder has a self-storing float and a piston rod that is held against rotation to assure correct alignment of the float.

7 Claims, 7 Drawing Figures

Fig. 1
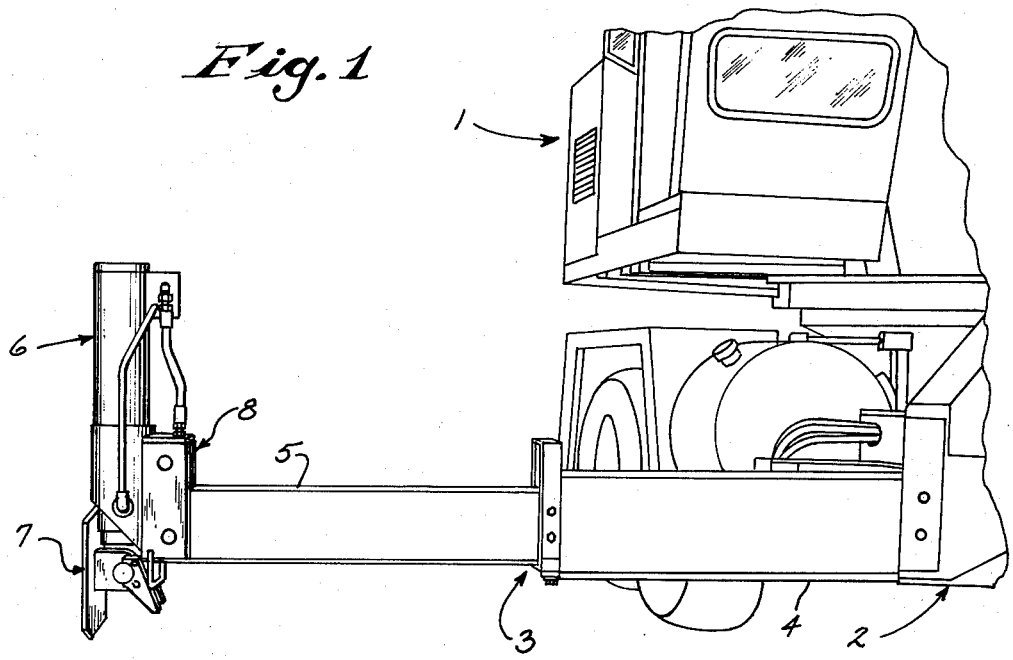
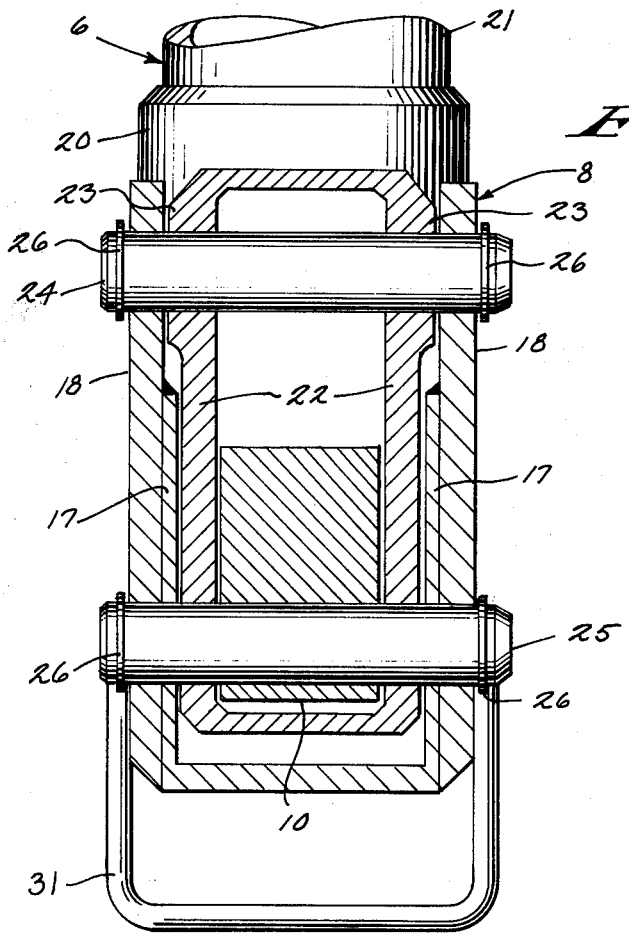
Fig. 4

MOUNTING FOR AN OUTRIGGER CYLINDER ON A CRANE

CROSS-REFERENCE TO RELATED APPLICATION

This is a continuation of U.S. Pat. application Ser. No. 412,374, filed Nov. 1, 1973 in the name of John T. Hornagold for "Mounting for Vertical Outrigger Cylinder," now abandoned.

BACKGROUND OF THE INVENTION

This invention relates to extensible outriggers for truck cranes and the like, and particularly to an improved mounting arrangement and other features relating to the vertical cylinders of such outriggers.

Truck cranes and similar machines are commonly provided with extensible outriggers comprising a single or multi-section horizontal beam that is extended and retracted by a horizontal cylinder, and a vertical cylinder that is mounted on the outer end of the beam and is provided with a stabilizing float. Particularly in truck cranes where travel width is a problem because of highway restrictions, it is desirable to have self-storing floats that can be pivoted to vertical storage positions alongside the vertical cylinders—this invention contemplates an arrangement in which the float is cammed to its stored position upon retraction of the vertical cylinder. Conventionally, vertical outrigger cylinders have a radial mounting flange at the rod end of the cylinder casing and are mounted by bolting this flange to the underside of the beam. This typical mounting arrangement, however, presents a number of major problems. For example, since the cylinder flange is substantially larger than the outside diameter of the casing, and since the float must clear the flange when in its stored position, the overall retracted length of the assembly is undesirably increased. Further, the wide flange presents clearance problems in the usual situation in which there are parallel and adjacent beam housings for the opposite sides of the machine, since the two housings must be moved farther apart to provide clearance for the flanges, which increases the width and weight of the outrigger beam assembly. Still further, since the cylinder flange is bolted to the underside of the beam with the casing extending through the beam, and since the beam is relatively close to the ground, removal of the vertical cylinder for repair or replacement is very difficult; it is usually necessary either to remove the outer beam section entirely or else dig a hole deep enough to allow the vertical cylinder to be removed from underneath the beam. Further, the flange defines and restricts the vertical elevation of the vertical cylinder, which in turn defines the ground clearance for the float as it moves to and when it is in the stored position; this problem might be resolved by raising the bottom wall of the beam to put the flange higher, but this is undesirable from the standpoint of beam strength and would put the flange at a level where there could be a clearance problem with the horizontal beam cylinder.

Attempts have been made to mount vertical outrigger cylinders by means of pins rather than flanges, but these have generally resulted in eccentric loading or presented other problems.

The noted clearance problems with a typical flange tend to multiply to the point where it is difficult or impossible to design a fully satisfactory outrigger assembly. It is, for example, generally accepted that the optimum extended spread, relative to the width of the machine, for dual, opposed outriggers with single section beams is approximately 2:1 (the spread for an 8 foot machine would be 16 feet) and the optimum ratio where the beams have two sections is 2.5:1 (20 feet for an eight foot machine); other design considerations generally prevent exceeding these ratios. With the typical flange mounting, however, and particularly with self-storing floats, it is virtually impossible even to reach these ratios while still providing a retracted length which does not exceed the width of the machine.

There are also design problems with regard to self-storing outrigger floats. Where, as contemplated in this invention, the float is cammed to its stored position upon retraction of the vertical cylinder, for proper operation it is necessary to provide some means to insure that the float is properly aligned relative to the camming member, which means must not create clearance or other additional problems or interfere with the freedom of the float to adjust for uneven ground conditions.

SUMMARY OF THE INVENTION

The present invention provides an improved mounting arrangement for vertical outrigger cylinders in which two vertically spaced mounting pins are employed to connect laterally extending plates on the vertical cylinder to the beam side walls, and wherein one of the pins also serves as a point of connection for the horizontal cylinder that activates the beam. This mounting arrangement allows for maximum extended length of the outrigger and minimum retracted length, size and weight. It is at the same time durable, relatively inexpensive and easy to manufacture, assemble and maintain.

The invention further contemplates a self-storing float arrangement in which the float is cammed to stored position in response to retraction of the vertical cylinder, and wherein the vertical cylinder has means to prevent rotation of the rod, thus preventing misalignment of the float, and in which the float is ball-mounted so as to be able to compensate for minor ground variations. The self-storing mechanism is efficient, simple and reliable, the non-rotational piston rod provides an effective but simple and inexpensive way to prevent misalignment of the float, and the ball mounting of the float is highly advantageous in compensating for uneven terrain but is also uncomplicated and relatively economical.

Other objects and advantages will appear from the description to follow.

Bried Description of the Drawings

FIG. 1 is a partial schematic view of a truck crane having outriggers incorporating the mounting arrangement and other features of the present invention;

FIG. 4 is an enlarged view in cross section through the plane 4—4 shown in FIG. 2;

DESCRIPTION OF THE PREFERRED EMBODIMENT

Figure 2:
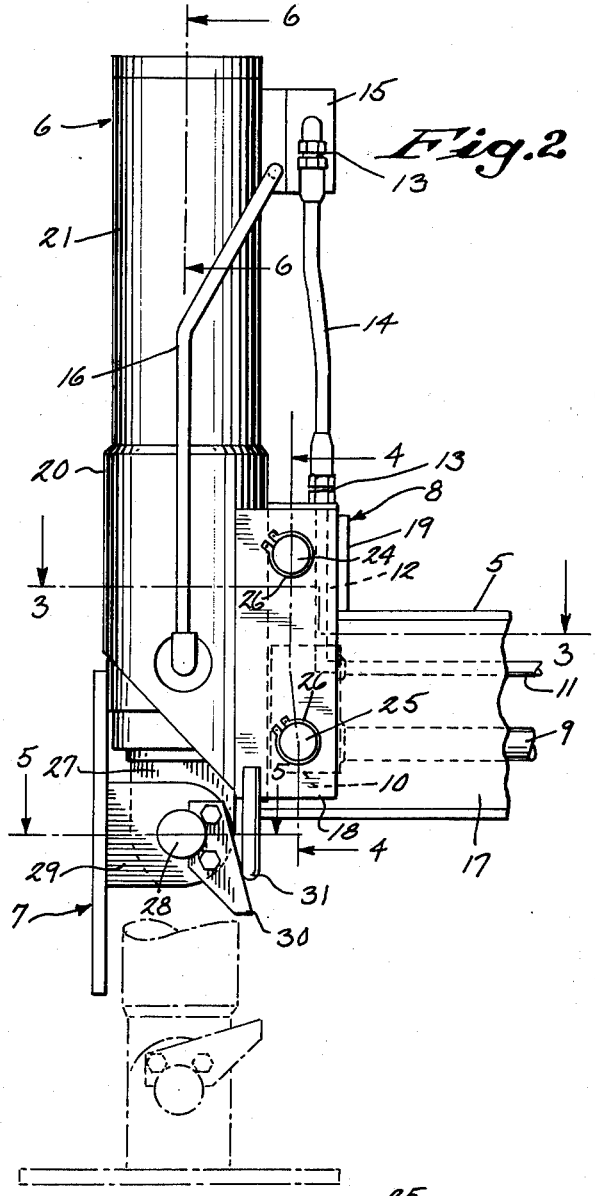
FIG. 2 is a fragmentary, enlarged side view of the outrigger of FIG. 1, showing the self-storing float in stored position and indicating, in phantom, the operating position of the float.

In FIG. 1, the reference numeral 1 designates generally a conventional truck crane with a wheeled carrier and revolving upper works. While the invention is particularly satisfactory for such machines, however, it should be understood that it is applicable to any construction or excavating machine or other machine or equipment of any type where outriggers are provided.

The outrigger assembly includes a transverse box housing 2 which is connected in conventional fashion to the underside of the carrier frame. As is usual, the housing 2 is dual, comprising two adjacent and parallel sections, one for a beam extending to one side of the machine and the other for an oppositely extending beam, and there are two such dual outriggers assemblies, one toward the front and one near the rear of the carrier. For the sake of simplicity only one beam and vertical cylinder are shown in detail, but the other three outriggers are the same.

The outrigger assembly includes a horizontally disposed outrigger beam assembly 3 which is extensibly and retractably received in the associated section of the housing 2 and in the preferred embodiment comprises two telescoping sections, an inner beam 4 and an outer beam 5. A double acting, hydraulic, vertical cylinder 6 carries a self-storing float 7 and is connected to the outer end of the outer beam 5 by means of the mounting arrangement designated generally by the reference numeral 8. While a two section beam is shown, the invention is of course equally applicable to outrigger assemblies with single section beams or beams with more than two sections.

Figure 3:
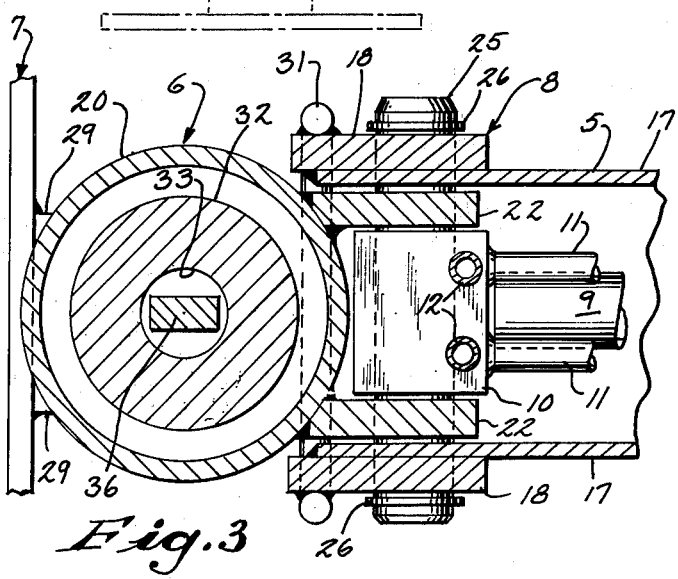
FIG. 3 is an enlarged view in cross section through the plane 3—3 shown in FIG. 2.

Turning to FIGS. 2–3, the beam assembly 3 may be extended and retracted by means of a double acting, hydraulic, horizontal cylinder located within housing 2 and connected to a fluid source (not shown) aboard the crane 1. As is well known to those skilled in the art, the casing (not shown) of the horizontal cylinder is within and connected to the housing 2 and the cylinder rod 9 extends out through the beam sections 4 and 5. Fixed to the outer end of the rod 9 is a fitting 10, which serves both as a connection fitting and a fluid transfer fitting as will be described. A pair of conventional telescoping fluid transfer tubes 11 lead from the internal fluid source to a pair of right angled passages 12 in the fitting 10, and a pair of pipe nipples 13 lead up from the passages 12. Lines 14 (only one of which can be seen) are connected to the nipples 13 and lead to a conventional lock valve 15, and lines 16 (only one of which can be seen) lead from the valve 15 to opposite ends of the cylinder 6. This arrangement in which the fitting 10, which serves as a connecting element as will be described, also serves as a fluid transfer fitting is particularly desirable, but other arrangements are possible.

The outer beam 5 is of box configuration and includes side walls 17 which extend to the outer end of the beam assembly 3. Reinforcing plates 18 are welded to the outside surfaces of and extend above the outer ends of the side walls 17 to serve as extensions of the side walls, the top wall of the outer beam 5 being cut away at the reinforcing plates 18. The upper ends of the plates 18 are connected by a transverse web 19 upwardly spaced from the top of the outer beam 5. The use of the extensions 18 is a convenient way of providing sufficient spacing for the mounting pins to be described, but they may not be necessary if the depth of the beam is sufficient.

A cylindrical collar 20 is welded or otherwise affixed to the casing 21 of the cylinder 6 near its lower end; and a pair of rectangular, parallel, vertical mounting plates 22 are welded or otherwise attached along one longitudinal edge to the collar 20 and extend below the casing 21. The collar 20 has an oblique lower end that extends below the casing 21 on the side toward the beam 5. The plates 22 might be mounted directly on the casing 21, but the collar 20 is preferable from the standpoints of strength and convenience. The oblique lower end allows the cylinder 6 to be mounted vertically higher while still providing a mounting surface for the entire length of the plates 22. The plates 22 extend toward the beam 5, and when the cylinder is in place they are inside the beam on opposite sides of the fitting 10 and inwardly alongside respective side walls 17 and extensions 18. To compensate for the thickness of the walls 17 and thus provide a more stable arrangement, the plates 22 have inwardly extending bosses 23.

As best seen in FIG. 4, two cylindrical, transverse metal mounting pins 24, 25 are utilized to fasten the vertical cylinder 6 to the outer beam 5, the pins 24 and 25 being vertically spaced, parallel and horizontally transverse to the beam 5 and plates 22. Upper pin 24 is removably inserted through an upper set of aligned apertures through plates 18 and plates 22 at the bosses 23. The lower pin 25 is removably inserted through a lower set of aligned apertures through plates 18, plates 22 and side walls 17, and is also received through a mating pin bore in the fitting 10. The pins, 24, 25 are provided at the protruding end portions with removable retaining rings 26. Having the mounting plates 22 received within outer beam 5 provides for minimum retracted length and there is no flange to present other clearance problems as noted above. In addition, the mounting arrangement 8 allows the vertical cylinder 6 to be easily mounted or removed from the side of the machine rather than from the underside of the beam 5. Furthermore, the rod 9 of the horizontal cylinder extends substantially completely to the vertical cylinder 6. The two pin mounting arrangement 8 also provides a very secure and stable connection.

As previously indicated, the float 7 is self-storing; and it is shown in FIG. 2 in both its stored position (full lines) and its working position (phantom lines). The float 7 is pivotally connected to the rod 27 of the cylinder 6 by means of a pin 28 which is parallel to the pins 24 and 25 and which extends through the bifurcated outer end of the rod 27 and through a bifurcated bracket 29 fixed to the top surface of the float 7. A pair of parallel plates 30 which serve as cam follower means are bolted or otherwise fixed to respective members of the bracket 29; and are engageable with a U-shaped camming member or deflector 31 the ends of which are fixed on the reinforcing plates 18.

The float 7 is freely pivotable about the axis defined by the pin 28, and when the rod 27 is extended it will pivot by its own weight to the working position shown in phantom lines in FIG. 2. When the rod 27 is retracted, however, the plates 30 will be brought against the camming member 31 before full retraction, and completion of the retraction will then cause the float 7 to be pivoted clockwise as seen in FIG. 2 to the stored position shown in full lines. When the float 7 is in stored position it is tight against the outer side of the cylinder 6 and the overall width of the outrigger assembly is significantly reduced. The self-storing arrangement shown is highly satisfactory and desirable, particularly for large machines with heavy floats.

Figure 6:
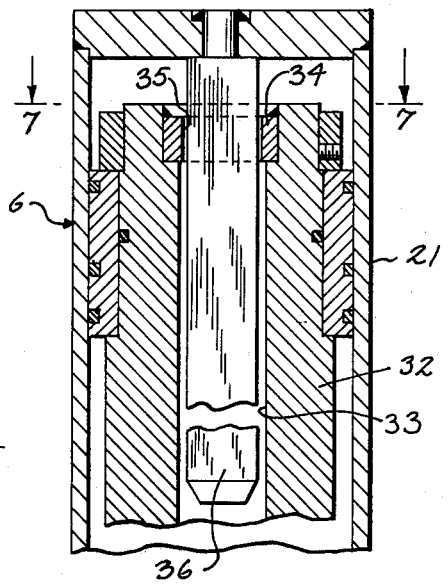
FIG. 6 is an enlarged, fragmentary view in cross section through the plane 6—6 shown in FIG. 2.
Figure 7:
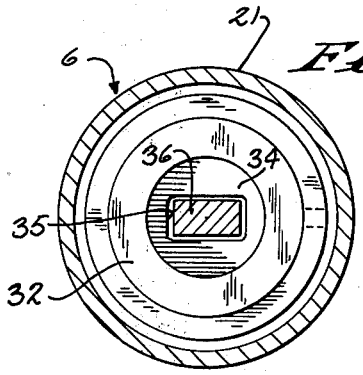
FIG. 7 is a view in cross section through the plane 7—7 shown in FIG. 6.

To insure proper engagement of the plates 30 and camming member 31, the float 7 must be kept in alignment, and this is accomplished by means within the cylinder 6. As can be seen most clearly in FIGS. 6 and 7, the piston 32 of the cylinder 6 is provided with an axial guide bore 33. A circular guide plate 34 is fitted at the inner end of the bore 33, and is provided with a non-circular preferably rectangular guide opening 35 therethrough. A mating guide member 36 of rectangular cross section is fixed to the end of the cylinder casing and extends through the opening 35 into the bore 33. The members 36 and 34 are in engagement to insure against rotation of the piston 32, and therefore the rod 27 and float 7, throughout the travel of the piston 32. The member 36 is preferably received relatively loosely through the opening 35 to prevent binding, the objective being to prevent only excess rotation which could result in such a degree of misalignment as to interfere with the self-storing action. While proper action of the self-storing mechanism is a primary concern, keeping the float 7 in alignment is also important to insure that the float 7 remains in proper position parallel to the machine while it is stored.

Figure 5:
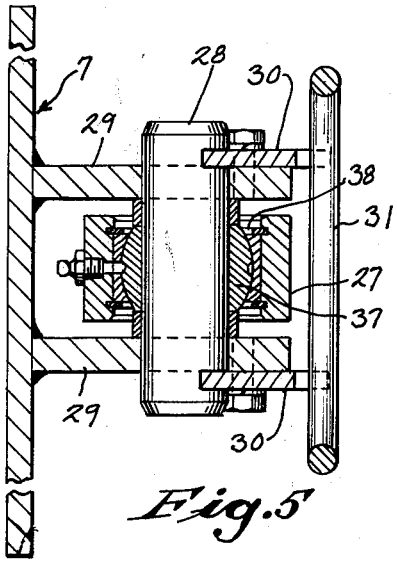
FIG. 5 is an enlarged view in cross section through the plane 5—5 shown in FIG. 2.

It is desirable to allow the float 7 limited movement in all directions to allow compensation for minor ground irregularities, and a generally conventional ball bushing arrangement is preferred. As can be seen in FIG. 5, a ball member 37 is fitted on the pin 28, and the outer end of the rod 27 is bifurcated to receive a socket member 38.

In operation, the beam assembly 3 is first extended and the cylinder 6 is then extended to put the float 7 on the ground, the float 7 being freed to assume its working position as the cylinder 6 extends. For travel to another site, the cylinder 6 is first retracted, which moves the float 7 to stored position, and the beam assembly 3 is then retracted.

The preferred embodiment shown and described provides all of the features and advantages discussed above, but noted and other variations are possible without departure from the spirit of the invention. The invention is not, therefore, intended to be limited by the showing or description herein, or in any other manner, except insofar as may specifically be required.

I claim:

1. A mounting arrangement for the vertical cylinder of an extensible outrigger assembly for truck cranes or the like wherein the outrigger is mounted on said crane and includes an extensible and retractable hollow beam having an outer end with opposite side wall means, said beam being connected to and actuated by an extensible and retractable horizontal cylinder rod that extends outwardly within the beam, a power source on said crane for actuating said cylinder rod, a vertical hydraulic cylinder mounted at the outer end of the beam, a power source on said crane for actuating the vertical cylinder, said vertical cylinder including a casing, an extensible and retractable rod and a piston connected thereto and wherein said rod and piston are movable in the casing, the improvement comprising a mounting means fixed to the casing of the vertical cylinder comprising a pair of parallel vertically disposed plates extending respectively alongside said beam side wall means, a first connector pin extending through the said plates and side wall means for securing the beam and vertical cylinder in assembled relationship, a fitting secured to the outer end of the horizontal cylinder rod, and a second connector pin spaced from said first connector pin extending through the said plates and side wall means and said fitting to secure the beam and vertical cylinder and horizontal cylinder rod in assembled relationship.

2. A mounting arrangement according to claim 1, wherein the mounting means comprises a cylindrical collar surrounding and fixed to the said vertical cylinder casing near its lower end, the collar having an oblique lower end that extends below the casing on the side of the said vertical cylinder facing the outer end of the said beam, and mounting plates fixed to said collar and extending below said casing.

3. The mounting arrangement according to claim 1, wherein the side wall means comprise side walls and extension plates fixed to said side walls and extending above the said side walls at the outer end of said beam, and said first connector pin extends through said mounting plates and said extension plates for securing said vertically extending cylinder to said beam.

4. The mounting arrangement according to claim 1, wherein a float is pivotally secured to the piston rod of said vertical cylinder, a cam follower is pivotally mounted to said float and a cam engaging member is fixed to the outer end of said beam, whereupon on retraction of the said piston rod into the said vertical cylinder, said cam follower will engage with said cam engaging member to cause said float to be pivoted to a vertical storage position alongside the said vertical cylinder.

5. The mounting arrangement according to claim 4, wherein means are provided within said vertical cylinder to prevent said piston rod from rotating therein when said cylinder is actuated by said power source to effect a downward and upward travel of said piston rod within said cylinder.

6. The mounting arrangement according to claim 5, wherein the means to prevent rotation of the vertical cylinder rod comprises: a guide bore opening through the inner end of the vertical cylinder piston, a guide plate mounted on the piston near the inner end of the said guide bore, said guide plate having a non-circular opening aligned with the guide bore, and a guide member fixed to the vertical cylinder casing, said guide member having a like non-circular configuration that mates with and extends through the guide plate opening and is of sufficient length to extend through the guide plate opening throughout the travel of the piston.

7. A mounting arrangement according to claim 1, wherein the fitting is provided with a plurality of fluid passageways extending therethrough for supplying and returning a fluid under pressure to and from the said vertical cylinder.

* * * * *